United States Patent [19]

Going et al.

[11] 4,063,552

[45] Dec. 20, 1977

[54] USER FORMED MOUTHGUARD

[76] Inventors: Robert E. Going, J. Hillis Miller Health Center, College of Dentistry University of Florida, Gainesville, Fla. 32610; Ronald E. Loehman, 964 N. California Ave., Palo Alto, Calif. 44303; Ming Sam Chan, Dept. of Heath & Rehabilitative Services, Office of Laboratory Services, P.O. Box 210, Jacksonville, Fla. 32201

[21] Appl. No.: 673,298

[22] Filed: Apr. 2, 1976

[51] Int. Cl.[2] ..... A61F 5/56

[52] U.S. Cl. ..... 128/136

[58] Field of Search ..... 128/136, 133, 132, 82; 32/14 B

[56] References Cited

U.S. PATENT DOCUMENTS

| | | | |
|---|---|---|---|
| 2,705,492 | 4/1955 | Chandler | 128/136 |
| 2,750,941 | 6/1956 | Cathcart | 128/136 |
| 3,124,129 | 3/1964 | Grossberg | 128/136 |
| 3,955,281 | 5/1976 | Weitzman | 32/14 B |

*Primary Examiner*—John D. Yasko

*Attorney, Agent, or Firm*—George H. Baldwin; Arthur G. Yeager

[57] ABSTRACT

A mouthguard, serving to protect the teeth, temporomandibular joint, head and neck, is user formed of silicone material by placing uncured silicone material in a tray, impressing the upper teeth into the material, removing the tray before complete curing of the material, impressing the biting or occlusal surfaces of the lower teeth into the material, and permitting the material to cure. The tray is flexible and may comprise two or more separate or separable pieces to facilitate removal. The tray is proportioned to contain a sufficient quantity of silicone material to provide effective thickness of material both outwardly and inwardly of the teeth in the complete mouthguard, and to be sufficiently deep to conform the guard at least to the gingival line without penetration of the teeth through the material into contact with the bottom of the tray, and at the same time to contain sufficient material to permit a certain excess thereof to be smoothed and spread, by use of the fingers, lips and tongue, across the upper outer gum surface and partially or completely across the hard palate. The width of the tray is sufficient, specifically, to provide sufficient material to permit the lower teeth to be sufficiently embedded in the material prior to curing that, when cured, the mouthguard will provide effective occlusal support.

7 Claims, 16 Drawing Figures

Fig. 12
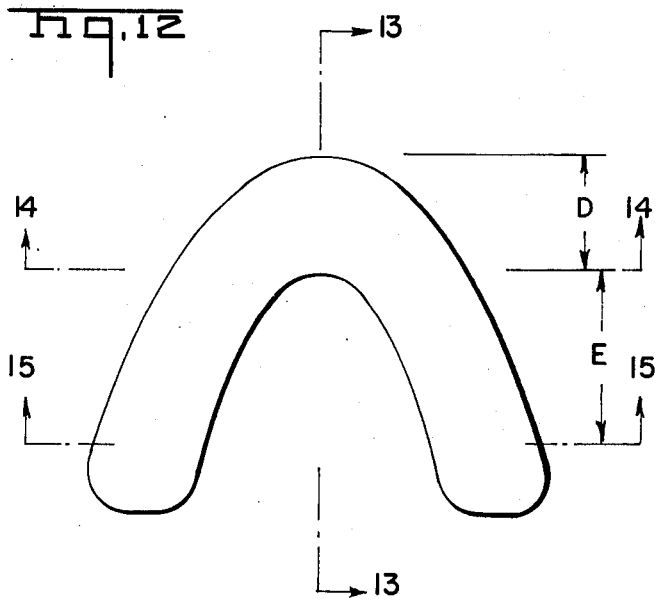
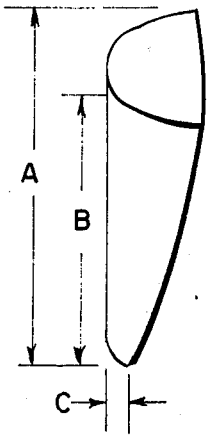
Fig. 13
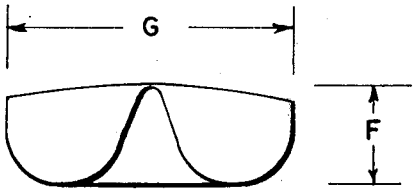
Fig. 14
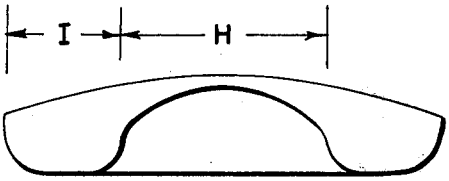
Fig. 15
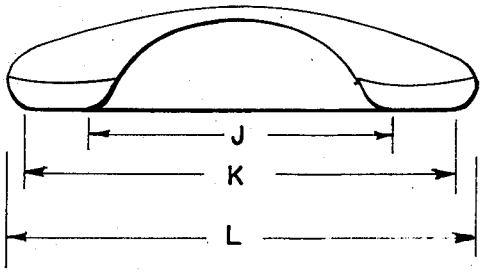
Fig. 16

USER FORMED MOUTHGUARD

The objects of this invention include the providing of an improved protective mouthpiece that is closely fitted to the teeth, and the providing of an improved method of forming a protective mouthguard.

A specific object is to provide a mouthguard which is readily formed by the user, which is comfortable to wear, long lasting, easy to clean, resistant to perforation by biting forces, effective in preventing damage to the teeth, jaws, head and neck in contact sports, one that may be tailored to the desires and anatomical needs of the wearer, that is not subject to unintentional displacement or loss from the mouth, and, specifically, one that may be fabricated to minimize speech interference and, accordingly, non-impeding to football signal callers and others who wish to be able to talk during the course of a game.

Another specific object is to provide a user-formed mouthguard which does not require heating, which may be molded into desired configuration in the mouth and one from which excess material may be readily removed.

A general object of the invention is to so simplify the forming of a mouthguard that a comfortable and effective guard may be formed by the prospective user with little or no experience, without help from others, in minimal time, and from a convenient and inexpensive packet or kit of materials and disposable accessory equipment, into a physiologically and anatomically effective, medically approved, and psychologically acceptable mouthguard.

The invention also has for its objects the provision of a mouthguard which is characterized by a soft cushioning consistancy thereby avoiding fatigue of the muscles of mastication, which is resistant to distortion and creep, as well as to chemical attack and deformation due to temperature changes, but which is comfortable and compatible with the soft tissues ofthe mouth. The mouthguard is readily formed to include deep or complete upper tooth impressions, which serve to retain the guard against unintentional displacement, and with shallow lower tooth impressions, which provide an optimum stable occlusal support position tending particularly to hold the lower jaw in place against injury in the event of lateral or vertical blows to the chin.

It has been previously known to employ methyl polysiloxane having nylon fibers embedded therein in forming teeth protectors, U.S. Pat. No. 3,224,443 to Monaghan; and it has been known to apply a methyl polysiloxane filler in a pre-formed silicone rubber channel, wherein the upper teeth are impressed into the filling material and this mateal is then permitted to set and become integrally bonded to the channel to form a composite teeth guard, U.S. Pat. No. 2,919,693 Ross. It has also been suggested to preform a rubber or the like trough member and to place a thermoplastic filler material therein, heating the trough and filler in hot water, and placing the trough in the mouth to impress the upper teeth in the filler, there to permit the filler to cool and harden, U.S. Pat. Nos. 2,705,492; 2,750,941; 3,073,300; 3,124,129; and 3,211,143. It is also known to place a heated and partially softened preformed saddle of thermoplastic resin in a tray, to utilize the tray to carry the saddle into the mouth in the tray and then to impress the upper teeth in the softened portion of the saddle, thereafter to remove the tray and saddle from the mouth after some cooling of the saddle, then with the saddle and tray out of the mouth, to remove the saddle from the tray and to replace the saddle in the mouth, and finally to close the jaws to impose lower tooth impressions before the saddle becomes too much cooled, U.S. Pat. No. 3,411,501. Some modifications of the teachings of these patents are disclosed in U.S. Pat. Nos. 2,827,899; 3,224,441; 3,379,193 and 3,485,242.

In order to fit satisfactory mouthguards to all members of a football squad, for example, and to comply with individual anatomical requirements and personal desires, it is necessary to provide for a wide range of sizes and shapes of jaws, for differences in volume of material actually to be embodied in the mouthguard, and for other varying requirements as to the final size and shape of the mouthguard. At the same time, it is desired that an effective mouthguard be readily formed by the individual user to suit his individual requirements and desires.

According to this invention these requirements are met with a small range of inexpensive disposable tray sizes, such as three sizes, accompanied by appropriate quantities of silicone putty, i.e. ranging from about 20 g. for the smaller trays to about 35 g. for the largest. The trays according to the invention, while rigid enough to shape the exterior of the guard into desired conformation are sufficiently deformable as to be usable with jaws which are wider or narrower than normal. Thus a user with a medium size jaw may successfully use a medium tray size although his jaw may be wider or narrower than an average or medium width.

Silicone materials such as employed in this invention tend to be substantially adherent to materials which would be suitable for use as trays in accordance with the invention. The desirability of silicone as a teeth guard material has been recognized, U.S. Pat. No. 2,919,693, and it has heretofore been suggested that a sausage like roll of uncured silicone be placed in the mouth without a tray, molded therein on the front upper teeth by use of the fingers, and then closing the jaws to impress the lower teeth into the material. See U.S. Pat. No. 3,224,443. While a skilled person, i.e. a dentist, may find it possible to form a satisfactory mouthguard in this manner, much care and considerable knowledge would be required, and it would be impractical for the members of a football squad, for example, to attempt in this way to equip themselves with satisfactory guards. It would be similarly impractical to sell simply a quantity of silicone material and catalyst to a member of the general public with written directions as to how the purchaser might form a satisfactory guard for himself. Moreover, previously suggested silicone materials have been too soft and too liable to biting through in use unless strengthened by fibers. The material according to this invention, however, is tough, and not subject to biting through when cured, hard enough to provide desired support, yet with sufficient softness to be comfortable in the mouth. Moreover, the material of this invention, and the method of forming the guard, provide a closer fit to the teeth and soft tissues than is provided by thermoplastic resin guards of the prior art. The closer fit permits softer materials.

U.S. Pat. No. 2,919,693 suggested loading of a prefabricated silicone channel with uncured silicone mixed with catalyst and impressing the upper teeth in the uncured silicone. Upon setting or curing of the silicone material in the channel, a mouthguard is formed, the channel and impressed silicone being bonded into a unitary structure. In this case it is necessary that the channel be so sized and proportioned as to provide a proper fit for the individual, requiring a large number of different sizes and shapes. Moreover, since guards so formed carry no impressions of the lower teeth, the protection afforded is much reduced and the guard is more subject to biting through and to being lost from the mouth. Such guards further tend to be undesirably bulky in the mouth and thus would quickly fatigue the muscles of mastication and would interfere with speech and breathing.

According to this invention, it is now possible and practical to provide comfortable and effective user-formed silicone mouthguards or mouthpieces having the upper teeth deeply impressed and the lower teeth indented into the guard, thereby taking advantage of the characteristics of silicone materials which are superior to the physical characteristics of thermoplastic materials heretofore proposed.

To meet these requirements, according to the present invention, a limited range of inexpensive trays, for example, in three sizes, are provided to allow for large wide jaws, as well as for what might be called normal or medium jaws, and for small jaws. The use of a tray makes it more likely that the untrained user will form a guard of effective shape and size and have complete control of the silicone in the uncured state, than if no tray is used to carry and shape the uncured, moldable material to the teeth.

Moreover, it is entirely practical and possible with a tray to provide a user-formed guard which extends from one to the other retromolar area with all of the upper teeth embedded in the guard, and with the guard closely and accurately fitting all of the upper teeth. By the use of a tray which extends not only along the front teeth but along the molars as well, the jaws may be closed so that the lower molars force the tray carrying the uncured silicone up toward the upper molars thereby to force the silicone material up into the upper molars, or in other words, to force the upper molars deeply into the silicone material.

Within the contemplation of this invention is the provision of a kit, or boxed package, to include a sealed flexible transparent plastic packet or pouch containing a quantity of silicone resin and a proportionate quantity of catalyst in respective compartments in the pouch separated by a frangible seal such that the seal may be broken without rupture of the packet, thereby to permit the catalyst and the resin to be kneaded together within the packet. The liquid catalyst contains a small quantity of food coloring. A homogeneous color distribution in the dough indicates uniform admixture of the catalyst. Following about a minute of such kneading, the packet may be torn open and the resin material removed. Packaged in the kit with the resin and catalyst packet is a disposable tray. The doughy uncured resin when removed from the packet is further kneaded in the hands as necessary to completely mix the catalyst, and it is then rolled between the hands into an elongated, roughly cylindrical or sausage shape of suitable diameter to fit within the tray. The roll of resin is bent into a U-shape as it is placed in the tray. The quantity of resin in the packet is proportioned to be sufficient for forming a guide for the jaw size for which the particular tray packaged therewith is proportioned.

It is important that the tray be readily removable from the mouthguard after partial curing thereof without misshaping the material or pulling it from the therein embedded or impressed upper teeth. The invention contemplates the provision of trays so coated interiorly, and of such characteristics as to stiffness and deformability, to permit the unskilled user so to pull it away from the mouthguard, yet with enough rigidity to cause the tray sufficiently to control the general shape of the guard that the final result will be an effective guard not so misshapen as to provide inadequate protection or fit. In this connection, two part trays, or tray assemblies, have proved successful, such trays, for example, comprising two parts joined together by a line of weakening and so arranged that, upon breaking along such line, one tray part or section may be removed to expose one part of the outer surface of the guard while the remaining part or section remains in place and is useful in permitting the user to hold the guard in position pending the later removal of this remaining part of the tray. Thus, for example, if the tray is divided into two equal parts, only one-half as much frictional or adherent resistance to the pulling away of one of the two parts of the tray is experienced as would be experienced if the whole tray wee pulled away at once. A two piece tray may also comprise a full outer tray, or tray part, lined with a smaller inner tray part, the inner tray constituting, in effect, a lining of, for example, about one half of the inner surface of the outer tray. All of the inner surface of the inner tray will be in contact with the guard, but only one half of the inner surface of the outer tray will be in such contact. The inner and outer tray being non-adherent to each other, the outer tray may be worked away from the partially cured guard with only one-half of the pulling-way force that would result were the inner tray or lining omitted. Thereafter, pulling away of the small inner tray is again accompanied by only one-half of the force tending to displace the guard as that which would be involved were a one-piece whole tray to be pulled away at one time. Thus tray means in the form of a two piece tray, or tray assembly, comprising a full outer tray lined with an interfitting smaller tray can effectively reduce the maximum force exerted in the direction to pull the guard away from the upper teeth, as the tray is being removed, to about one-half of what it would be with a single unlined full tray.

Separation of the tray from the guard is facilitated by forming the tray of, for example, polystyrene of not more than about 0.02 inches or 0.5 mm. in thickness, which, while stiff enough to retain the general overall shape of the tray during the impressing of the upper teeth, is sufficiently deformable that, with a fingernail, a small upper edge portion of the tray may be pulled away from the silicone surface to admit air and thereby break the vacuum seal which would otherwise exist. The tray, if generally stiff, is preferably coated interiorly with a release agent such as a vegetable oil applied as a thin film coating the interior trough-defining surfaces of the tray.

The novel features which are believed to be characteristic of this invention are set forth with particularity in the appended claims. The invention itself, however, both as to its organization and method of operation, together with further objects and advantages thereof, may best be understood by reference to the further description which follows taken in connection with the accompanying drawings, in which:

FIG. 12 is a top plan view of a typical tray in accord with the invention;

FIG. 13 is a sectional view of such tray taken along line 13—13 of FIG. 12;

FIGS. 14 and 15 are sectional views of such tray taken, respectively, along lines 14—14 and 15—15 of FIG. 12; and FIG. 16 is a rear elevational view of such tray.

Figure 1:
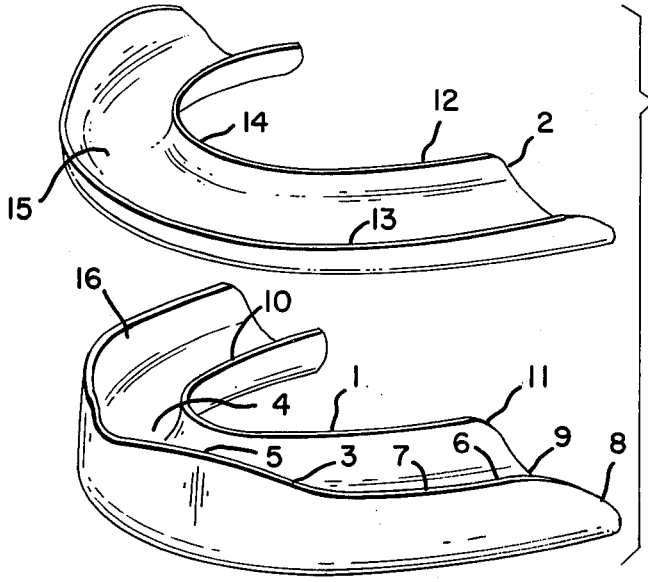
FIG. 1 is a perspective view of a two-piece nesting tray assembly in accord with the invention.

Referring to FIG. 1, the tray assembly shown comprises an outer portion 1 and a linear or inner portion 2 shaped and proportioned to fit or nest entirely and conformingly within the outer portion. Each tray portion may be about 0.5 mm. thick polystyrene, or if desired, the inner portion may be formed of material 0.2 to 0.4 mm. thick and the outer of material about 0.5 mm. thick. The outer tray portion has an outer or buccal and labial wall or flange 3 rising to about 14 to 20 mm. above the bottom 4 at its maximum height at 6 where the buccal area 7 of the flange terminates in a downward curve 8 adjacent the rear or retromolar area 9. The inner or palatal flange 10 is shown as of generally constant height, which may be between about 9 to 13 mm., between the downwardly curved terminal ends 11.

The inner and outer flanges 12 and 13 of the nesting inner tray are preferably no more than about half as high as the average height of the flanges of the outer tray portion, and typically, the forward portion at 14 of the palatal flange may be about 8 mm. high with this flange being 1 or 2 mm. less high toward the rear of the tray, while the outer flange 13 may be from about 3 to 6 mm. in height above the bottom of the tray portion.

With the tray portion 2 fittingly nested in tray portion 1, and when the unpolymerized doughy silicone material is placed in the tray and the upper teeth are impressed therein, all as later described, the portion of the outer surface of the material, now a partially cured incipient mouthguard, which is in contact with the inner surface of the composite tray is not less than about half in contact with the inner surface 15 of the inner tray portion and is not more than about half in contact with the inner surface 16 of the outer tray portion above the upper edges of the respective flanges of the inner tray portion. The inner surfaces 15 and 16 are preferably coated with a film of vegetable oil release coating, and, specifically, such film may comprise between about 16 and 20 mg. of "Mazola" vegetable, e.g. corn oil coated on the trough-defining inner tray surfaces, for a medium adult tray size.

The outer tray portion 1 may, for a typical medium adult size jaw, have an overall width of approximately 80 mm. and an overall length of about 68 mm. While the tray bottom is preferable somewhat rounded between the flanges, it may be approximately 10 mm. wide. The inner flange is inclined slightly inwardly and away from the outer flange so that the spacing between the upper edge of the outer flange and the upper edge of the inner flange is between approximately 18 to 25 mm. The outer flange curves upwardly from the bottom of the tray and is substantially perpendicular with respect to the plane of the bottom of the tray from its upper edge down to approximately one half of the tray depth.

Figure 2:
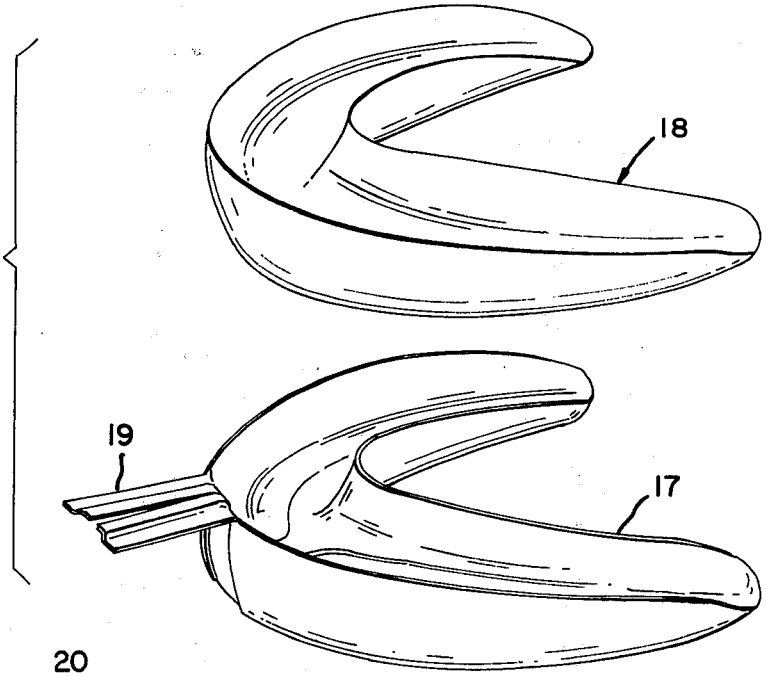
FIG. 2 is a similar view of a modified two-piece nesting tray assembly.

The two part tray assembly shown in FIG. 2 differs from that of FIG. 1 in that the shape and relative proportions of the outer tray portion 17 are modified, the inner tray portion 18 has flanges which are generally the same height as those of the outer tray portion, and a tab 19 is provided on the outer labial flange of the outer tray portion. Moreover, the inner tray portion 18 is, while self-supporting, substantially soft, limp, flexible and tough, and of material which is similar to thin rubber except that it is more resistant to stretching and possesses memory, i.e. retarded elastic response, rather than rapid elastic recovery from stretching. The material of the inner tray should be substantially non-adherent to the uncured silicone teeth guard material as well as to the outer tray portion. Polyvinyl acetate-polyethylene co-polymer materials with a thickness of from about 0.1 to 0.4 mm. have proved satisfactory for the tray portion 18. The limp inner tray porton fits conformingly into and is supported by the much more rigid outer tray portion while the uncured silicone roll is being pressed thereinto by the fingers and while the upper teeth are being impressed into this silicone material. The outer tray portion 17 may be formed of polystyrene of about 0.5 to 0.8 mm. thickness and is characterized by being stiff but slightly bendable, so that, by pulling tab 19 forwardly, for example, the outer tray edge may be pulled a few millimeters away from the inner tray portion and then the outer tray portion may be manually urged or pulled gradually away from the inner tray portion. With the outer tray portion removed, the flexible inner tray portion may be grasped at an edge and peeled off. Being limp, it may be curled abruptly away from the partially cured mouthguard, and it has been found that no release agent is necessarily required since the adhesion between the guard and inner tray is broken over a very small area, almost a line area, at one time, and the force tending to pull the guard from the teeth is, accordingly, small.

The trays 17 and 18, for a medium adult jaw, may have a maximum depth in the forward labial area of about 15 mm., a maximum distance between the upper edges of the inner and outer flanges of about 20 mm., and a overall length, excluding tab 19, of about 60 to 65 mm.

Figure 3:
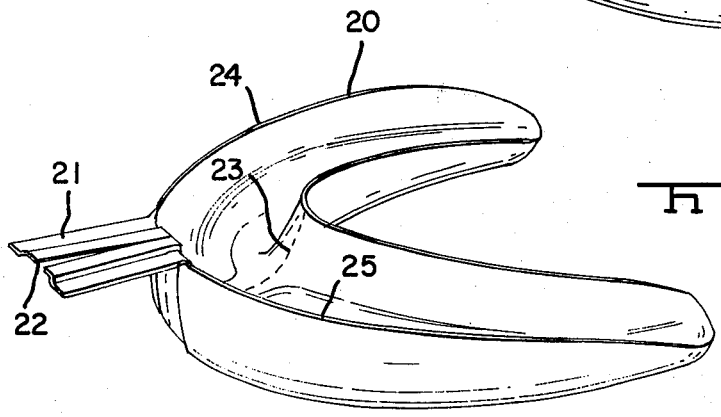
FIG. 3 is a perspective view of a tray comprising two divisible parts in accord with a further modification of the invention.

The tray 20 of FIG. 3 may be identical to tray portion 17 except that the tab 21 is slit longitudinally as seen at 22, and that this slit extends along a line of weakness represented by a series of serrations 23 along the centerline of the tray and completely across the tray. Upon grasping the tab 21 on opposite sides of the slit, or by grasping the tab on one side of the slit and holding or steadying the laterally opposite portion of the tray, such as portion 24, half portion 25 of the tray must be completely separated from the other. With the tray portions 24, 25 divided along the line of weakness and unconnected to each other, one of the portions, such as portion 24, may be worked away from the mouthguard while the other 25 is manually held in place. In that portion 24 covers only one half of the tray-engaged surface of the guard, the total adhesion, or area of frictional or vacuum adherence of the part being removed, is only one-half as great as it would be for a whole undivided tray. Moreover, air may be admitted along the edge separated along the line 23, and the portion 24 is less rigid than was the whole tray prior to its being broken in half and the edges and corners of the portion 24 can be readily pulled away from the guard by manipulation with a fingernail or by further pulling on the half of the tab 21 which remains attached thereto. When one of halves 24, 25 has been removed, the other half is, of course, removed in the same manner. In this case, as with the tray portions 1 and 2 of FIG. 1, since the tray portions are relatively rigid, the inner surface of the tray portions are preferably sprayed or otherwise coated with a vegetable or silicone oil release agent to facilitate removal.

Figure 4:
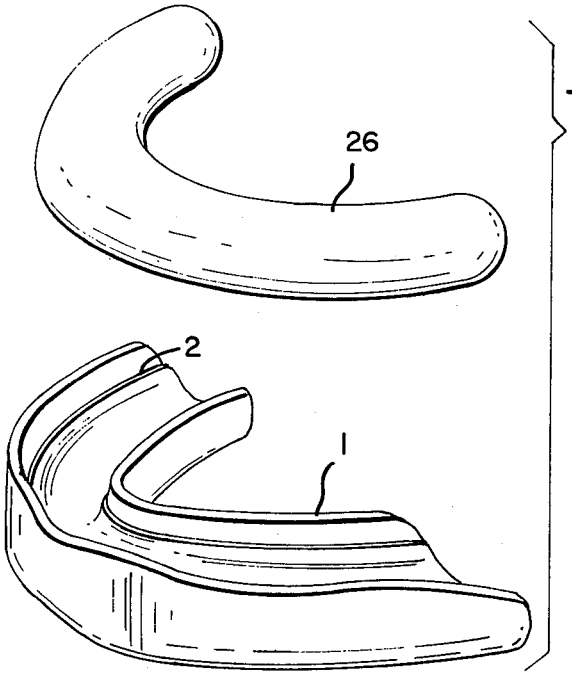
FIG. 4 is an exploded perspective view of a tray and roll of uncured silicone material for placing in the tray.

The tray assembly of FIG. 4 comprises an outer tray portion 1 with an inner portion 2 nested therein, and with the inner surface of portion 2 and the portion of the inner surface of tray portion 1 which is exposed above tray portion 2 coated with a release agent. A bent roll of uncured silicone resin 26 is shown ready for placing in the tray assembly, there to be molded by the fingers into the trough so as to take on the shape of and, at least substantially, to fill the trough of the tray. The tray, when so packed with the silicone material is ready for insertion into the mouth of the ultimate wearer.

In some cases it has been found acceptable to use a single tray 17 coated interiorly with a release agent as described herein and without a lining element 18 nested therein. The thickness and stiffness or flexibility of the tray material are selected for the relative size of the dental arch being fitted, and such thickness and stiffness determines whether a single tray will satisfactorily maintain the shape and optimal distibution of the silicone material while being sufficiently flexible to permit removal, or whether a two part tray, comprising parts 1 and 2 of FIG. 1, or parts 17 and 18 of FIG. 2, or parts 24 and 25 of FIG. 3, will be required.

Figure 5:
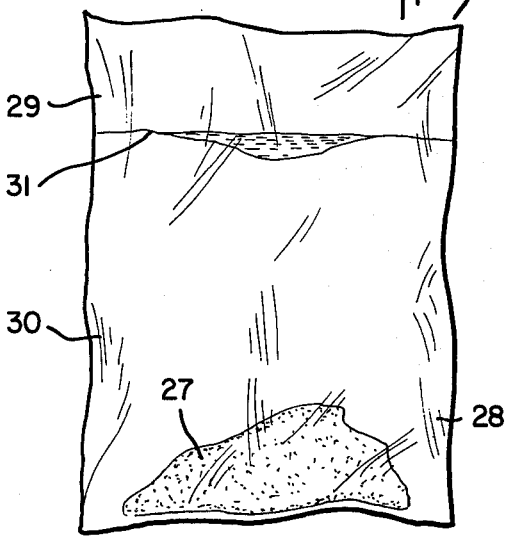
FIG. 5 is a front view of a plastic pouch or packet containing quantities of silicone resin and the catalyst therefor in separate compartments.

The silicone material employed to form the teeth guard is, preferably, a high molecular weight poly (dimethyl siloxane) polymer with silanol stopped chains, to which calcium carbonate and zinc oxide are added as fillers, and with sufficient trialkoxy silane and/or tetralkoxy silane to cure the polymer. In accord with the invention a quantity 27 of such silicone mixture, such as 30 gm., thereof, is packaged, referring now to FIG. 5, in a clear polyethylene pouch 28 formed of 0.05 mm. material, for example, and which may be about 7 or 8 cm. long and 5 cm., wide. The pouch includes a separate compartment therein which may be in the form of a sealed capsule or which, as shown in FIG. 5, comprises a small compartment 29 separated from the larger compartment 30 containing the silicone material by a line 31 heat sealed across the pouch. Contained in the small compartment 29 away from the silicone is a proportional amount of catalyst material, such as 0.6 cc specifically stannous neodecanoate in a silicone oil diluent containing an integral hindered phenol antioxidant. Such catalyst may be formulated by mixing 50 parts of stannous neodecanoate (21 percent stannous ion content) with 50 parts of polydimethyl siloxane of a viscosity of between 10 and 50,000 centipoise, or typically, 100 centipoise at 25° C. About 0.05 parts per hundred of Calco Oil Blue is preferably added to the catalyst as a visual aid to assess homogeneity when the catalyst material is mixed with the silicone material.

Figure 6:
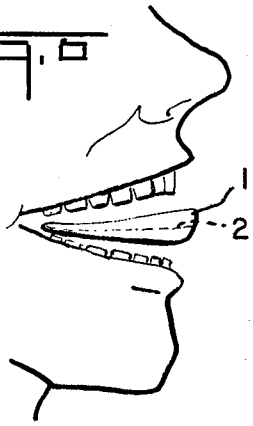
FIGS. 6, 7 and 8 are elevational views representing steps in the method of forming a mouthguard in accord with the invention.
Figure 9:
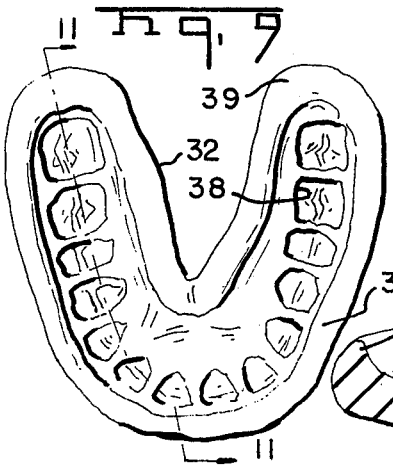
FIGS. 9 and 10 are top plan views of mouthguards in accord with the invention.
Figure 10:
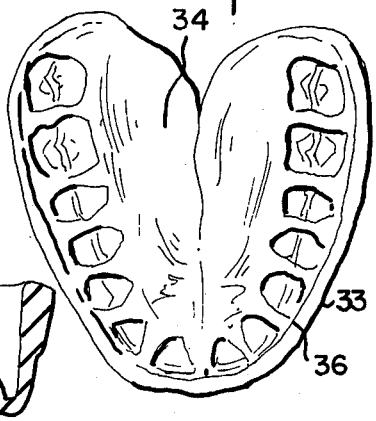

The material is prepared by manually breaking the seal of the catalyst compartment 29, permitting the catalyst components to reach the silicone material within the pouch, by kneading the pouch with the hands and fingers for approximately one minute, tearing open the pouch and kneading the material removed therefrom in the hands sufficiently vigorously for an additional one minute to insure thorough mixing, as determined by homogeneous color, and, in the next half minute, molding and rolling the material into generally cylindrical shape and bending it into the U-shape or bent sausage shape as seen at 26 in FIG. 4 and then pressing this shape into the trough of the tray. Now, substantially two and one-half minutes after the mixing of catalyst and silicone was begun, the filled tray is placed in the mouth, as shown in FIG. 6, and at first pushed up over the teeth, preferably by equal and simultaneous thumb pressure under each side of the tray, and by partially closing the lower jaw against the bottom of the tray. The tray is thus pushed upwardly sufficiently to embed the upper teeth and at least part of the upper gums into the silicone material in the tray. Material which the teeth and gums force out above the upper tray edges, and from the ends into the retromolar area, is smoothed out with the index finger, dampened with saliva, along the outside gum surfaces, and, if desired, across the inside hard palate area. In so smoothing and shaping the material, it is helpful to use the tongue, and finger pressure against the cheeks. The finger and tongue are also used to shape the material which oozes into the retromolar area. Some portions of the putty above the tray may, however, be trimmed away by the fingernail of the index finger before the material has cured. The user may elect to trim away all excess material inside the upper gums, thereby to form a guard 32 with no roof or hard palate covering, such as shown in FIG. 9, or he may elect to spread this extra material, with the finger and tongue, across the roof of the mouth to form, as shown in FIG. 10, a guard 33 with a substantially complete hard palate. While the guard 33 with palate portion 34 is less subject to displacement or loss during contact sports, and while it is unobjectionable to some users, others may find it uncomfortable or even intolerable. Speech is less affected by the guard 32 with no covering of the palate.

While trimming with the fingernail before curing is convenient, the guard may be readily further trimmed with scissors after curing of the silicone material.

While the above described shaping, smoothing and trimming with the fingernail is being accomplished, the tray retains and supports the material in the desired shape and position in the important area of the teeth themselves up to and preferably slightly above the attached gingival line along the upper teeth.

Figure 7:
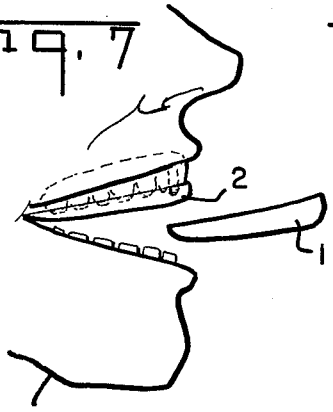
Figure 8:
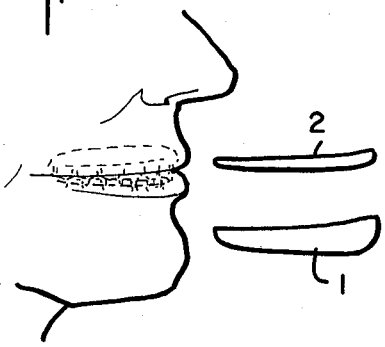

As soon as possible after the impressing of the upper teeth and after the original contouring with the finger, tongue and cheeks, aided as necessary by trimming with the fingernail, the outer tray portion is removed from the now partially cured teeth guard as indicated in FIG. 7 and immediately thereafter the inner tray portion 2 is removed, leaving the silicone material engaged on the upper teeth as seen in FIG. 8. The lower jaw is promptly closed sufficiently to impress the lower teeth partially into the silicone material. Such impression should be sufficient to form approximately half of the crown length of the lower teeth and the whole occlusal or incisal patterns in the silicone material. In the mouthguard so formed, the compressive biting load is distributed over the entire cross-sectional area of the teeth in contact therewith. The lower incisors will normally be impressed somewhat deeper into the material than the lower molars, but care should be taken that the lower jaw is not so far closed as to cause any lower tooth to break through the silicone and contact any upper tooth. Specifically it is preferred that a minimum of 1.5 mm. of the silicone material remain between any upper tooth and the nearest approach of any lower tooth, with an average spacing between each upper tooth and the closest approach thereto of any part of the corresponding lower tooth ranging between about 2.5 and 3.5 mm.

The thickness of the guard above the gingival line may vary from about 1.5 to about 4 mm., with the upper edge 35 being generally rounded, as in FIG. 9, or tapering to a thin or almost sharp upper edge 36 as shown in FIG. 10.

The jaws are retained in the position shown in FIG. 8, with the guard engaged on the upper teeth and with the lower teeth impressed therein as above described, but without imposing any biting force on the guard, for 4 to 6 minutes, by the end of which time the mouthguard will be sufficiently cured to permit it to be removed from the mouth. The user may choose to leave the newly fabricated guard in the mouth, if it is formed immediately prior to a game or a practice session. In this situation the mouthguard has maximum adhesion to the teeth and soft tissues due to the capillary attraction provided by the user's saliva. A maximum first level adhesion secures the mouthguard so well that it is difficult to dislodge with finger pressure. This ensures the user who is required to call signals (such as the quarterback and linebackers) optimum retention and stability during use. At the end of the game the mouthguard can be removed. Once the initial adhesive state is broken it is never as adhesive unless another new mouthguard is fabricated. Most players do not require or desire adhesion to this degree, and therefore prefer to take them out freely during a game or from time-to-time in a practice session. A second level of adhesion is obtained by the player, through biting on the mouthguard to firmly seat it, and sucking the air from between the guard and the tissues as one would suck on a small bit of hard candy or cough drop. A wet mouth or a rinsed mouthguard, rinsed with water or mouthwash, aides in obtaining a satisfactory second level of adhesion. Some few players may desired or require a third level of adhesion which may be gained with a denture adhesive powder or the like.

In providing a releasse coating to the trough surfaces of the tray, a very thin film is desired. For example, the whole interior surface may be so coated with corn oil so as to leave between 15 and 20 mg. on the surface. A greater thickness of oil has been found to provide excessive lubrication permitting the silicone to slide out of the tray, particularly while the upper teeth are being impressed. Too little oil makes it difficult to separate the tray away from the partially cured silicone material in which the upper teeth are embedded, without partially displacing the material from the teeth, thus distorting it and reducing the excellent retention characteristic of the substantially perfect conformance or fit of the guard formed as described.

If it were necessary to wait until the silicone was substantially cured before pulling away the tray, it would be more difficult or impossible to make deep impressions of the opposing lower teeth in the underside of the silicone mouthguard.

The reaction for applying a light coating of corn (or silicone) oil release coating is to aid release from the soft, semi-sticky putty. If the tray material were thin and flexible enough, it might be possible to remove it without a release coating, but then the tray would not have the stiffness to guide the silicone material into proper anatomical position or to retain the proper external configuration.

Figure 11:
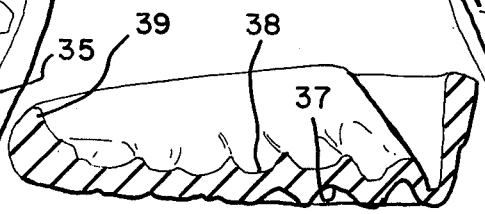
FIG. 11 is a sectional view of a portion of a mouthguard taken generally along line 11—11 of FIG. 9.

As seen in FIG. 11, the indentations 37 of the lower teeth range from about 1 to 2 mm. for molars, up to about 3 or as deep as 4 mm. for incisors and eye teeth, depending substantially upon the specific tooth conformation or the individual. The impressions 38 of the upper teeth are much deeper in that, preferably, the upper teeth are completely impressed and the guard extends over at least a part of the upper gums above the attached gingival line. With the jaws closed against the guard, any lateral movement of the lower jaw from its natural position with respect to the upper jaw is restricted in that both upper and lower teeth are closely engaged in the guard and damage from blows against the lower jaw as well as damage to the lower teeth and temporomandibular joint, and to minimize the chance of a concussion. Moreover, the upper teeth, particularly the front upper teeth, are further protected in that they tend to be reinforced by the lower teeth. The silicone material has been found substantially completely to fill all interdental spaces between upper teeth whereby the force of a blow to the jaw is distributed to the upper teeth and to the lower teeth as well, thereby minimizing the force on any single tooth.

Suitable silicone materials include those designated and sold by General Electric Company as GE 15 C or GE 252 A, mixed with a suitable catalyst prepared as described above. The preferred silicone material is in accord with U.S. Pat. No. 2,843,555, and such as to have a specific gravity, when cured, of 1.32.

The GE 252A base resin consists of a high molecular weight polydimethylsiloxane polymer with silanol stopped chains containing $CaCO_3$ and ZnO fillers with an alkoxide silane (tetraethylsilicate) as the crosslinking agent. The reaction which crosslinks the polymer chains in the 252A material is initiated by small amounts of dibutyl tin laurate or stannous octoate as a catalyst. The GE 15C material consists of the same polymer but lacks the crosslinking agent and contains a proprietary filler intended to make the cured product harder than 252A. In the 15 C material, the polymer is mixed with a second component, GE 15 CB, which comprises the crosslinking agent tetraethyl silicate and a catalyst, dibutyl tin laurate, to initiate curing.

A specific advantage of silicone over thermoplastic materials is in the closer conformance of the material to the surfaces of the teeth, permitting the use of a softer material. A guard which does not fit closely to the teeth is more subject to biting through since the biting force is applied to the guard only through the sharp cusps of the teeth, whereas, in the silicone guard according to this invention, the force applied to the guard is distributed across the whole planar projected area of the teeth. The compression stress/strain characteristics of the silicone material according to the invention show that for high stress levels, characteristic of blows to the jaw, the compressive modulus is four or more times the modulus for the low stress levels characteristic of the user clenching his jaws on the guard. Thus the guard provides initially maximum impact absorption at low stress levels and greatly increased strength and durability, and a much higher modulus at higher stress levels. The low initial compressive modulus optimizes user comfort since users have a natural tendency to bit or clench on mouthguards and the softness minimizes fatigue of the muscles of mastication.

The GE 252A silicone, cured with 1.0% dibutyl tin laureate shows, for strain slowly applied, i.e. at 0.2 inches per second, a strain of about 0.20 inches per inch at 50 psi; about 0.32 inches per inch at 100 psi; about 0.5 to 0.55 inches per inch at 200 psi; about 0.60 to 0.65 at 400 psi; and about 0.70 inches per inch at about 600 to 800 psi. For strain rapidly applied, i.e. at 20 inches per second, a strain of about 0.40 inches per inch is produced by a stress of about 600 psi; of about 0.5 inches per inch by a stress of 1,000 psi; and a strain of about 0.65 to 0.79 inches per inch with a stress of 2,000 psi.

As to the safety of the GE 252A material for use in the mouth, extraction tests of the material cured with a stannous catalyst in simulated saliva at 100° C for four hours resulted in an average of 2.4 micrograms of tin extracted per gram of the silicone material. Assuming a 25 to 35 gram mouthguard, some 60 to 85 micrograms of tin might be extracted. In that the daily diet of Americans has been reported to contain an average of 17 milligrams of tin, the tin extracted from the mouthguard in use would be only a very small fraction of this daily intake and thus pose no threat of adverse toxicologic effects. Animal tests and use of the guards on humans have shown no mucousal irritation from the silicone material.

As seen in FIG. 11, it is desirable that a potion 39 of the guard extend upwardly behind the rear upper molars serving both to increase the anchorage of the guard against loss from the mouth and as a further cushion between the upper and lower jaws.

After the guard material has completely cured or polymerized, and when it is outside of the mouth, it may be tailored, as suggested above, to enhance the comfort by means of scissors. The guard may be used over and over, and sterilized between wearings by boiling water or other procedures.

A small quantity of U.S. P. peppermint, i.e. 0.01 to 0.05 parts per 100, or other similar flavoring may be mixed with the silicone putty prior to polymerization if desired. Such flavoring may be originally incorporated, for example, in the putty 27 in the compartment 20 of the pouch 28.

Dimensions of appropriate typical medium size tray to accommodate average dental arches, are shown in the following tabulation, in which the dimensions are given with respect to the distances indicated in FIGS. 12, 13, 14, 15 and 16:

| Dimension | Medium |
|---|---|
| A | 60 mm. |
| B | 46 mm. |
| C | 4 mm. |
| D | 20 mm. |
| E | 32 mm. |
| F | 16 mm. |
| G | 48 mm. |
| H | 38 mm. |
| I | 20 mm. |
| J | 52 mm. |
| K | 74 mm. |
| L | 80 mm. |

These dimensions are described as follows:

A - overall

B - from back end to about where inner wall meets bottom of trough

C - depth of trough at rear end

D - top of inner and outer walls at centerline

E - top of inner wall at centerline to where maximum overall width first occurs

F - overall top to bottom

G - width overall at section 14—14

H - width between tops of inner walls at section 15—15

I - width of trough at tops of walls at section 15—15

J - (end view) distance between junctures of inner walls with trough bottoms

K - distance between junctures of outer walls with trough bottom

L - overall width between tops of outer walls

A set of three trays, including such a medium tray, a small tray having the dimensions as given above multiplied by 0.8, and a large tray, of which the dimension F is 20 mm., I is 26 or 27 mm., J is 55 mm., K is 77 mm. and L is 88 or 89 mm., with other dimensions as given for the medium tray, is satisfactory to provide a selection for forming of guards for nearly all adult mouths except for persons having unusually small or large dental arches.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. Tray means for holding a mass of dough-like uncured silicone material in the shape of a rod bent into a U shape while forcing the upper teeth into such mass and thus forcing the inner, outer and lower surfaces into conforming contact with the whole inner trough-defining surface of such tray means, said tray means comprising two separable troughed portions, one of which has an inner surface in such contact with at least approximately one half of the total of such inner, outer and lower surface area, and the other of which includes an exposed outer surface and is separately movable away from such first portion and from such mass without disturbing such contact between said mass and said inner surface of said first portion.

2. The combination according to claim 1 wherein said one portion is limp and constitutes a liner for said other portion, and said other portion is semi-rigid to support said one portion and retain the outer shape of such material in substantially the unflexed shape of the trough during such forcing of the upper teeth into such mass.

3. The combination according to claim 1 wherein said portions are joined along a breaking line and each has an inner surface in contact with a respectively different approximate half of said total area.

4. The combination according to claim 3 wherein said breaking line is a line of weakness located along the centerline of the tray means.

5. Dental tray means for holding a generally bent sausage shaped mass of dough-like uncured silicone material during the impressing into such mass of the upper teeth of the prospective wearer of a teeth guard to be formed of such mass, said tray means comprising a trough-defining element of thin, semi-rigid plastic material, sufficiently rigid to retain substantially its unflexed shape during the impressing of upper teeth into uncured silicone putty material therein and sufficiently yielding to permit a small edge portion thereof to be pulled by a fingernail away from the putty material therein, and film means lining the inner trough-defining surface of said element and adapted and arranged to separate such uncured putty material from direct contact with said surface.

6. The combination according to claim 5 wherein such film means is a thin film of oil effective as a release coating for the trough-defining surface of said element.

7. The combination according to claim 5 wherein such film means comprises a highly flexible and limp plastic material liner element lining said trough, said liner element being non-adherent to said tray element and peelable from such putty material when exposed upon removal of said tray element from such liner element.

* * * * *